United States Patent [19]

DeWoolfson

[11] Patent Number: 4,492,295

[45] **Date of Patent: * Jan. 8, 1985**

[54] AUTOMATED REDEMPTION CENTER FOR METAL CONTAINERS

[75] Inventor: Bruce H. DeWoolfson, Arlington, Va.

[73] Assignee: Environmental Products Corporation, McLean, Va.

[ * ] Notice: The portion of the term of this patent subsequent to Aug. 24, 1999 has been disclaimed.

[21] Appl. No.: 377,918

[22] Filed: May 13, 1982

Related U.S. Application Data

[63] Continuation-in-part of Ser. No. 355,206, Mar. 5, 1982, Pat. No. 4,440,284, which is a continuation-in-part of Ser. No. 148,371, May 9, 1980, Pat. No. 4,345,679.

[51] Int. Cl.[3] ..... G07F 7/06

[52] U.S. Cl. ..... 194/4 C; 100/902; 194/1 E; 194/4 E

[58] Field of Search ..... 194/4 R, 4 B, 4 C, 4 D, 194/4 E, 4 F, 4 G; 100/902

[56] References Cited

U.S. PATENT DOCUMENTS

| | | | |
|---|---|---|---|
| Re. 27,643 | 5/1973 | Myers | 194/4 R |
| 1,901,528 | 3/1933 | Olsen . | |
| 2,228,294 | 1/1941 | Wurzbach . | |
| 2,558,255 | 6/1951 | Johnson et al. . | |
| 2,691,379 | 10/1954 | Foushee . | |
| 2,908,440 | 10/1959 | Gurewitz . | |
| 2,943,306 | 6/1960 | Gray et al. . | |
| 2,954,111 | 9/1960 | Garrard . | |
| 2,968,235 | 1/1961 | Marica . | |
| 3,011,036 | 11/1961 | LaRocca . | |
| 3,015,376 | 1/1962 | Glembring . | |
| 3,039,583 | 6/1962 | Menefee . | |
| 3,066,600 | 12/1962 | Couty et al. . | |
| 3,191,609 | 6/1965 | Gauselmann et al. . | |
| 3,343,638 | 9/1967 | Putman, Sr. . | |
| 3,411,625 | 11/1968 | Calhoun . | |
| 3,467,855 | 9/1969 | Rance . | |
| 3,489,354 | 1/1970 | Harper et al. . | |
| 3,492,564 | 1/1970 | Baker, Jr. . | |
| 3,564,267 | 2/1971 | Walter . | |
| 3,662,181 | 5/1972 | Hercher et al. . | |
| 3,776,128 | 12/1973 | Morris . | |
| 3,792,765 | 2/1974 | Arp | 194/4 C |
| 3,828,242 | 8/1974 | Vann . | |

(List continued on next page.)

FOREIGN PATENT DOCUMENTS

| | | | |
|---|---|---|---|
| 354258 | 10/1905 | France . | |
| 52-498 | 1/1977 | Japan | 194/4 C |
| 52-8683 | 1/1977 | Japan . | |
| 286301 | 2/1928 | United Kingdom . | |

OTHER PUBLICATIONS

Arp, U.S. patent application Ser. No. 612,088, filed Sep. 10, 1975, (Aban.).

Arp, U.S. patent application Ser. No. 742,662, filed Nov. 17, 1976, (Aban.).

C. J. Leftanlt, Jr., "Reversed Vending Machine Encourages Aluminum Conservation", Machine Design, vol. 53, No. 16, Jul. 9, 1981.

*Primary Examiner*—David A. Scherbel
*Assistant Examiner*—Edward M. Wacyra
*Attorney, Agent, or Firm*—Finnegan, Henderson, Farabow, Garrett & Dunner

[57] ABSTRACT

Apparatus for collection of metal containers and for direct payment of refund deposits for containers bearing a distinguishing indicia, including an exterior housing having an access port therein, a container access area sized to accommodate both crushed and non-crushed containers, a metal detector for determining whether a container offered by a customer is substantially aluminum or steel, an optical sensing device for detecting the presence of the distinguishing indicia, a movable shelf responsive to the metal detector and the optical scanning device for accepting a container identified as being substantially aluminum or steel and bearing the distinguishing indicia, a dispenser for dispensing refunds for containers accepted, a crusher for crushing the containers, and a bag for storing the crushed containers.

13 Claims, 7 Drawing Figures

U.S. PATENT DOCUMENTS

| | | | |
|---|---|---|---|
| 3,857,334 | 12/1974 | Arp . | |
| 3,875,498 | 4/1975 | Mahan et al. . | |
| 3,907,087 | 9/1975 | Tanaka | 194/4 C |
| 3,955,179 | 5/1976 | Planke . | |
| 3,961,238 | 6/1976 | Randolph, Jr. . | |
| 3,996,510 | 12/1976 | Guichard . | |
| 4,010,766 | 3/1977 | Bowles et al. . | |
| 4,091,725 | 5/1978 | Arp | 100/DIG. 2 X |
| 4,130,792 | 12/1978 | Sullivan . | |
| 4,138,709 | 2/1979 | Colwill . | |
| 4,141,493 | 2/1979 | Arp | 194/4 R X |
| 4,241,821 | 12/1980 | Wu et al. | 194/4 C |
| 4,245,731 | 1/1981 | Herbst et al. | 194/4 C |
| 4,248,334 | 2/1981 | Hanley et al. | 194/4 C |
| 4,248,389 | 2/1981 | Thompson et al. . | |
| 4,316,533 | 2/1982 | Hughes et al. | 194/4 C |
| 4,324,325 | 4/1982 | DeWoolfson | 194/4 C |
| 4,345,679 | 8/1982 | DeWoolfson | 194/4 C |

AUTOMATED REDEMPTION CENTER FOR METAL CONTAINERS

RELATED APPLICATION

This application is a continuation-in-part of my prior copending U.S. patent application, Ser. No. 355,206, filed Mar. 5, 1982, entitled "Automated Aluminum Can Redemption Center for Direct Return Deposit Payout", (now U.S. Pat. No. 4,440,284) which is a continuation-in-part of U.S. patent application Ser. No. 148,371 filed May 9, 1980, entitled "Container Collection Apparatus with Electromagnetic Sensor and Method" (now U.S. Pat. No. 4,345,679).

BACKGROUND OF THE INVENTION

This invention relates to apparatus for collecting and storing used metallic containers and, more particularly, machines for collecting, crushing and storing used beverage cans in those jurisdictions where container deposit legislation has been enacted, and for return to consumers of deposits on beverage cans so collected.

With the increasing emphasis in recent years on energy conservation, the recycling of metallic containers such as beverage cans has become an important factor in the conservation effort. More specifically, the recycling of aluminum cans has proven to be remarkably efficient in energy saving. Yet only a fraction of the total annual production of aluminum beverage cans is recovered after use, with the remainder being discarded often as litter. Recovery of steel or other metal containers is also desireable for environmental and economic reasons.

As a result of these problems, many jurisdictions have now enacted mandatory deposit laws which require deposits on all beverage containers including cans. Such laws create additional problems for the grocery industry and a great deal of attention has been directed to the development of an efficient and effective method for receiving returned containers and paying the necessary deposit refunds. However, to date no refund system is believed to have successfully solved the refund problems discussed, and an inordinate amount of time and effort is presently spent on the part of the grocery industry in effecting refunds in those jurisdiction which require deposits.

Several machines have been developed in the prior art for encouraging the recovery and recycling of metallic containers. For example, U.S. Pat. Nos. 3,857,334 and 3,907,087 disclose apparatus for crushing metallic containers and discharging refund coins or tokens in exchange therefor. U.S. Pat. No. RE 27,643 describes a process and apparatus for collection of metal containers in which tokens are automatically dispensed for the containers collected. In general, the prior art machines induct any type of inserted container, and then utilize some type of sensing means for differentiating between those containers for which a token is to be dispensed and those containers for which no payment is to be made. For example, Arp, U.S. Pat. No. 3,857,334 includes control means for issuing a token only when cans of a given size, weight and design are crushed in the machine. Myers, U.S. Pat. No. RE 27,643 discloses a mechanism which utilizes a plurality of bar magnets for separating cans formed of magnetic material from non-magnetic cans.

Several of the prior art apparatus are designed to take advantage of the shape of the container in feeding the metallic containers into the apparatus. This type of feeding mechanism has an inherent drawback in that the containers must be sufficiently close to their original shape to roll down an inclined surface. As a result, a large majority of containers which have been totally or partially crushed by the user, cannot be fed into such machines efficiently. In addition, the sensing or differentiating mechanisms of the prior art machines do not appear to be adaptable to operation on partially or fully crushed containers of different sizes.

At least one prior art machine has included a mechanism for effecting direct repayment of deposits. Arp, U.S. Pat. No. 4,141,493 describes a device for use with a can having an identifying indicia in the form of a specially shaped can identifying indicia embossed on one end thereof. Two probe members sense the presence of the can indicia, and complete a circuit when the indicia is present to effect payout of the applicable deposit. This mechanism apparently requires that the container be sufficiently close to its original shape so that the ends of the container will align with and complete a circuit through the probes. It also requires that one end of every deposit container has the indicia embossed thereon, and that the can be held in a particular orientation for sensing.

Since a large proportion of beverage cans are crushed or flattened by a user, the type of indicia and sensing mechanisms found in the prior art may not be useful to effect direct return deposit payout on such cans. Furthermore, the prior art machines have difficulty accepting such cans at all.

Accordingly, it is a primary object of this invention to provide an improved container collection apparatus which is capable of readily accepting containers in their originally manufactured shape, or containers which have been manually deformed by consumers, and which returns a deposit directly to the consumer for each accepted container on which a deposit has been previously made.

It is a further object of this invention to provide a container collection machine with a sensing mechanism which can readily detect the presence of both aluminum and steel containers of varying sizes, can do so prior to accepting the inserted container into the interior of the machine, and can also detect the presence of an identifying indicia on the can for direct payment of a return deposit.

Another object of the invention is to provide an improved container collection apparatus with a mechanism for detecting the presence of both aluminum and steel containers which have been deformed from their originally manufactured shape.

It is an additional object of this invention to provide an improved method of collecting and storing empty aluminum and steel containers and providing direct payment of a return deposit therefor.

Additional objects and advantages of the invention will be set forth in part in the description which follows and in part will be obvious from the description, or may be learned by practice of the invention. The objects and advantages of the invention may be realized and obtained by means of the instrumentalities and combinations particularly pointed out in the appended claims.

SUMMARY OF THE INVENTION

To achieve the foregoing objects and in accordance with the purpose of the invention as embodied and broadly described herein, the apparatus of this invention comprises preselection means for exposing a crushed or non-crushed container offered by a customer to an electromagnetic field for identifying whether the container is substantially aluminum or steel, and for detecting the presence of a distinguishing indicia on the container. The preselection means includes a container access area configured to accommodate both crushed and non-crushed containers for exposure to the field. The apparatus also includes means for accepting only a container identified by the preselection means as being substantially aluminum or steel, and as having said distinguishing indicia, independent of the configuration of the container; coin-dispensing means responsive to the preselection means for dispensing a predetermined payment in return for containers having a substantially aluminum or steel composition and carrying the distinguishing indicia; means cooperating with the accepting means for crushing the containers; and means for storing crushed containers received from the crushing means.

Preferably, the distinguishing indicia includes ultraviolet sensitive phosphorescing means; and the preselection means preferably includes illuminating means for exposing the crushed or non-crushed container to an ultraviolet light source, and light detection means for generating an electric signal in response to the presence of a predetermined amount of phosphorescence.

The accepting means preferably includes means for depositing the containers by gravity into the crushing means. Preferably also, the apparatus includes an exterior housing having an access port therein, and a shelf positioned within the port for allowing manual insertion of a container into the container access area. The apparatus may also include a door covering the access port and means preventing operation of the apparatus when the door is open.

BRIEF DESCRIPTION OF THE DRAWINGS

The accompanying drawings which are incorporated in and constitute a part of the specification, illustrate one embodiment of the invention, and together with the description, serve to explain the principles of the invention.

Of the drawing.

DESCRIPTION OF THE PREFERRED EMBODIMENT

Figure 1:
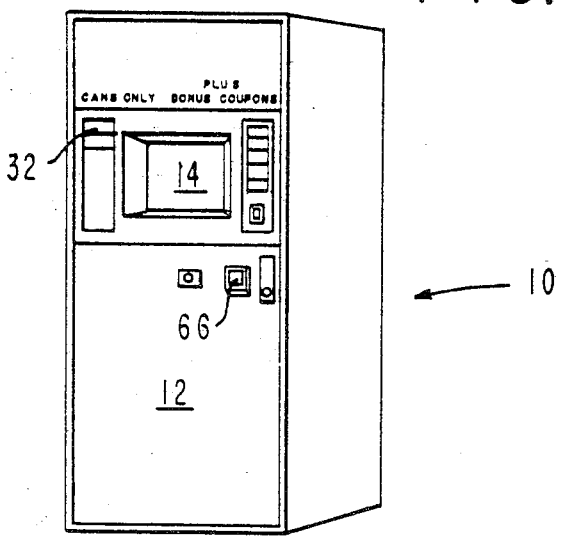
FIG. 1 is perspective view of the exterior of the apparatus.
Figure 2:
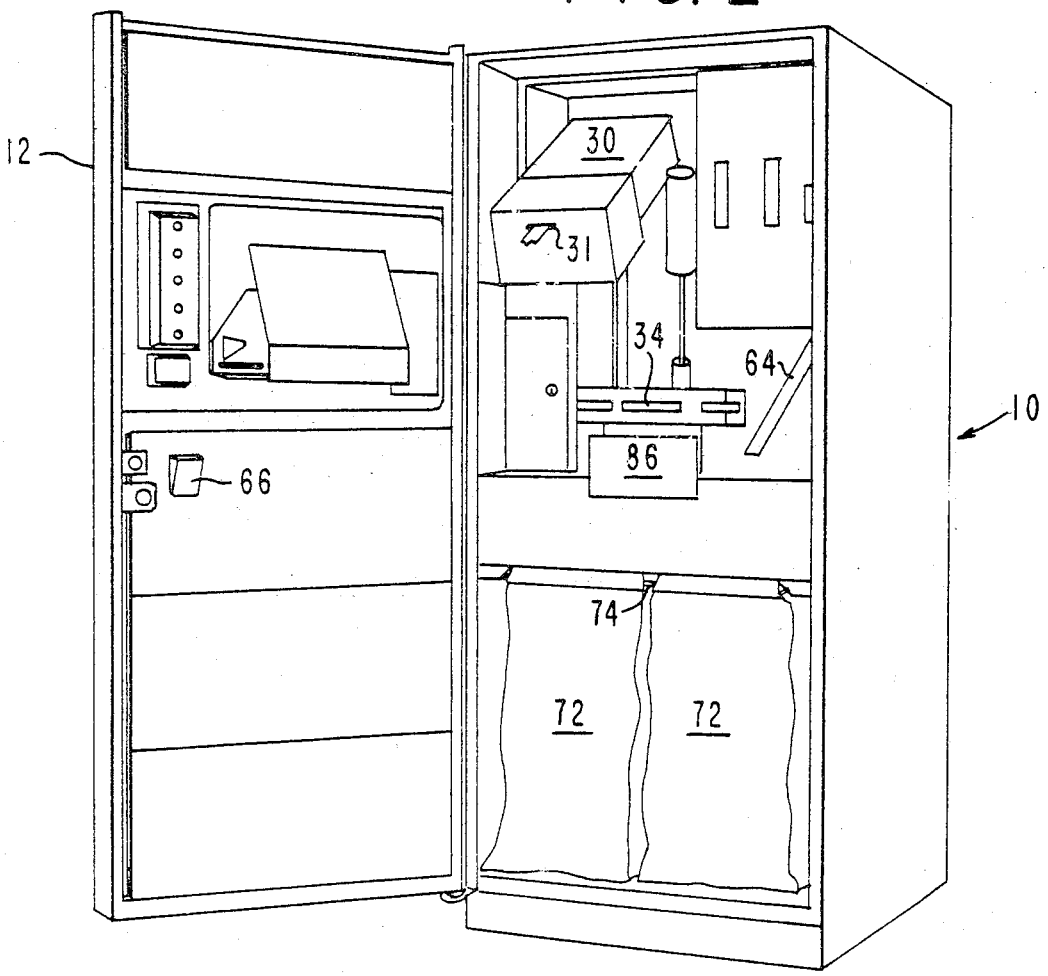
FIG. 2 is a front view of the interior portion of the apparatus and the rear of the front door.
Figure 4:
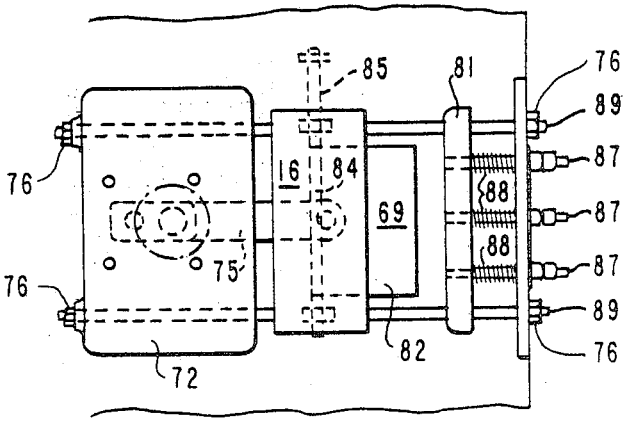
FIG. 4 is a top view of the crushing mechanism of the invention with the piston in the open position.
Figure 5:
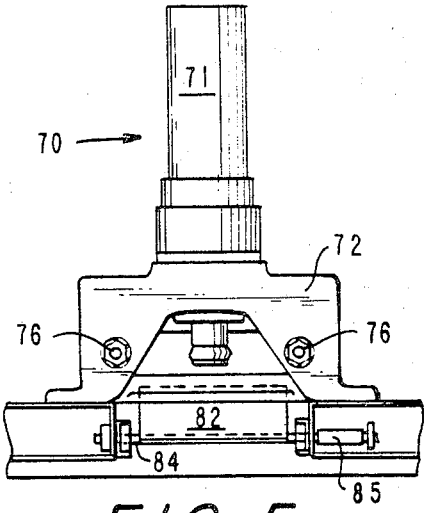
FIG. 5 is a rear view of of the crushing mechanism of the apparatus.

Reference will now be made in detail to the present preferred embodiment, an example of which is illustrated in the accompanying drawings. Referring now to FIGS. 1 and 2, it may be seen that the container collecting apparatus provides a rapid and efficient means for collecting containers for recycling, and effecting direct payment of return deposits. The apparatus for collection of containers generally includes a rectangular cabinet housing 10 having a front wall 12 which is hinged to allow access to the interior of the housing 10 for maintenance of the operating components and to allow for removal of the containers collected in the apparatus.

Figure 3:
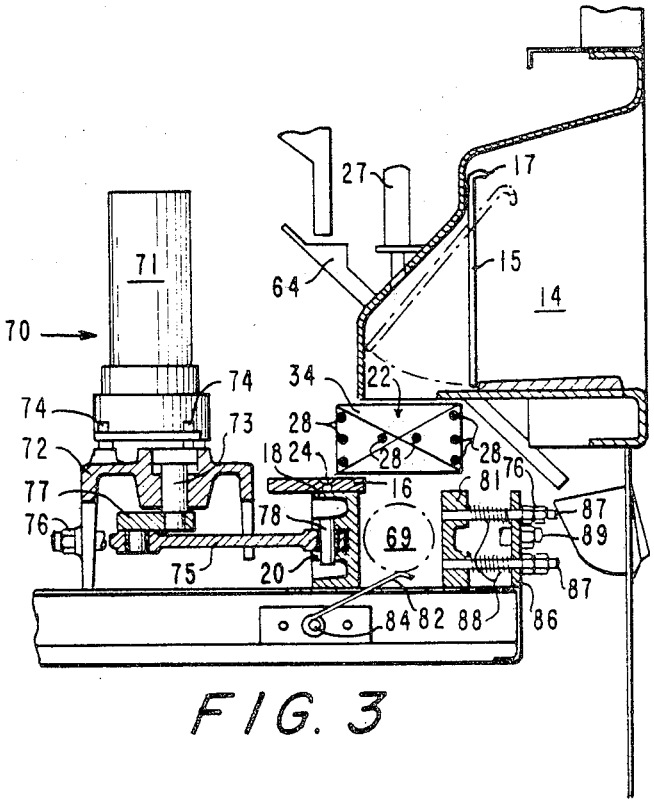
FIG. 3 is a right side cutaway view of the access and crushing portions of the apparatus.

In accordance with the invention, the apparatus includes preselection means for exposing a crushed or non-crushed container offered by a customer to an electromagnetic field for identifying whether the container is substantially aluminum or steel without direct physical contact with the container, and for detecting the presence of a distinguishing indicia on the container. The preselection means includes a container access area configured to accommodate both crushed and non-crushed containers for exposure to the field. As embodied herein, the preselection means includes an access port 14 in the front wall 12 of the housing 10. A door 15 covers the access port 14, and the door 15 may be provided with an electronic locking mechanism (not shown) which prevents operation of the apparatus when the door 15 is unlocked. As shown in FIG. 3, door 15 may also include means for automatically opening the door upon unlocking, such as a spring. The door 15 also preferably includes a lip 17 for facilitating the opening of the door to remove a non-acceptable container from the container access area 22.

Preferably, the distinguishing indicia includes ultraviolet sensitite phosphorescing means; and the preselection means includes illuminating means for exposing the crushed or noncrushed container to an ultra-violet light source, and light detection means for generating an electric signal in response to the presence of a predetermined amount of phosphoresence from the indicia on the container. As herein embodied and as best shown in FIG. 3, the preselection means includes a metal detector 34 disposed in the walls of container access area 22. The metal detector 34 is mounted in the apparatus so that a container inserted into the access port 14 onto the shelf 16 will be disposed adjacent the detector 34. The metal detector means is preferably mounted on opposite sides of the container access area 22. However, other configurations and designs may be used. A preferred arrangement for the detection means is disclosed in commonly owned U.S. patent application Ser. No. 248,022, filed Mar. 26, 1981, which is incorporated herein by reference. Another form of detector is disclosed in allowed U.S. patent application Ser. No. 148,371, now U.S. Pat. No. 4,345,679, which is also commonly owned, and is incorporated herein by reference.

Although the above applications describe apparatus which is specifically oriented toward detecting aluminum, the general arrangement may be utilized to detect the presence of a steel can, by modifying the phase detector to identify a phase relationship caused by the presence of a ferromagnetic material such as steel. This would be readily apparent to a person skilled in the art from the disclosure of U.S. Ser. No. 248,022.

Thus, the detector 34 can discriminate between aluminum and steel cans, and containers formed of other materials. The detector 34 can accomplish this without regard to the configuration of the container, as described in the material incorporated by reference.

In accordance with the invention, the apparatus also includes means for accepting only a container identified by the preselection means as being substantially aluminum or steel and bearing the deposit indicia, independent of the configuration of the container.

Preferably, the accepting means includes means for depositing the container by gravity into a crushing means. As herein embodied, the accepting means includes a shelf 16 forming a horizontal plane on the top edge 18 of a reciprocating piston member 20. The piston 20 forms the crushing mechanism in the apparatus, and will be described in more detail below. The shelf 16 forms the floor of the container access area 22 (also described hereinafter) when the crushing mechanism is not operating. Shelf 16 may be formed of any suitable material, and is attached to piston 20 by means of screws 24. When a container is inserted into the container access area 22, the container rests directly on shelf 16. During operation of the machine the piston 20 retracts from under container access area 22, thereby moving shelf 16 out of its position and allowing the container to drop by gravity into the crushing mechanism.

In the illustrated embodiment, the preselection mechanism is actuated by a current from the apparatus power supply (not shown). When an acceptable container is determined to be present, the current through the sensing circuit is cut off and the crushing and dispensing means are actuated.

If a container having a composition other than desired or not bearing the appropriate identifying indicia is inserted into the container access area 22, and the sensing means are actuated, the identification circuitry will indicate that an undesired container is present, and the apparatus will not operate further to accept the container. Thus, only containers of either aluminum or steel, and bearing the deposit indicia will be received and crushed by the apparatus.

When the operation of the preselection means identifies the composition of the container as either aluminum or steel and as being entitled to return deposit, the shelf 16 moves out of position by the action of piston 20, allowing the container to drop into the crushing area 69.

As herein embodied the illuminating means includes a light source 27 mounted to permit direct illumination of the crushed or non-crushed container. The light source 27 is preferably a "black light" which emits ultra-violet radiation. As here embodied, the phosphorescing means includes a material on the container which is preferably in the form of an enlarged dot or spot on one end of the container and which may be easily applied during the manufacturing or packaging operation. This material may be included on a sticker or adhesive label, or may be painted onto the container. An ultra-violet sensitive ink may be utilized for this purpose. The phosphorescence by the spot is detected by a series of phosphorescence sensors 28. The sensors 28 may be mounted on opposite sides of the container access area 22, or in any other location which provides adequate exposure to the luminescence emanating from the container indicia.

The amount of phosphoresenece is measured by the sensors 28. If the sensor reading meets a predetermined criteria, an electric signal is generated for actuating the counting mechanism of the coin dispensor to pay the customer a refund of the deposit amount.

In accordance with the invention, the apparatus also includes coin dispensing means responsive to the preselection means for dispensing payment in return for containers having a substantially aluminum or steel composition and bearing the distinguishing indicia of deposit.

Figure 7:
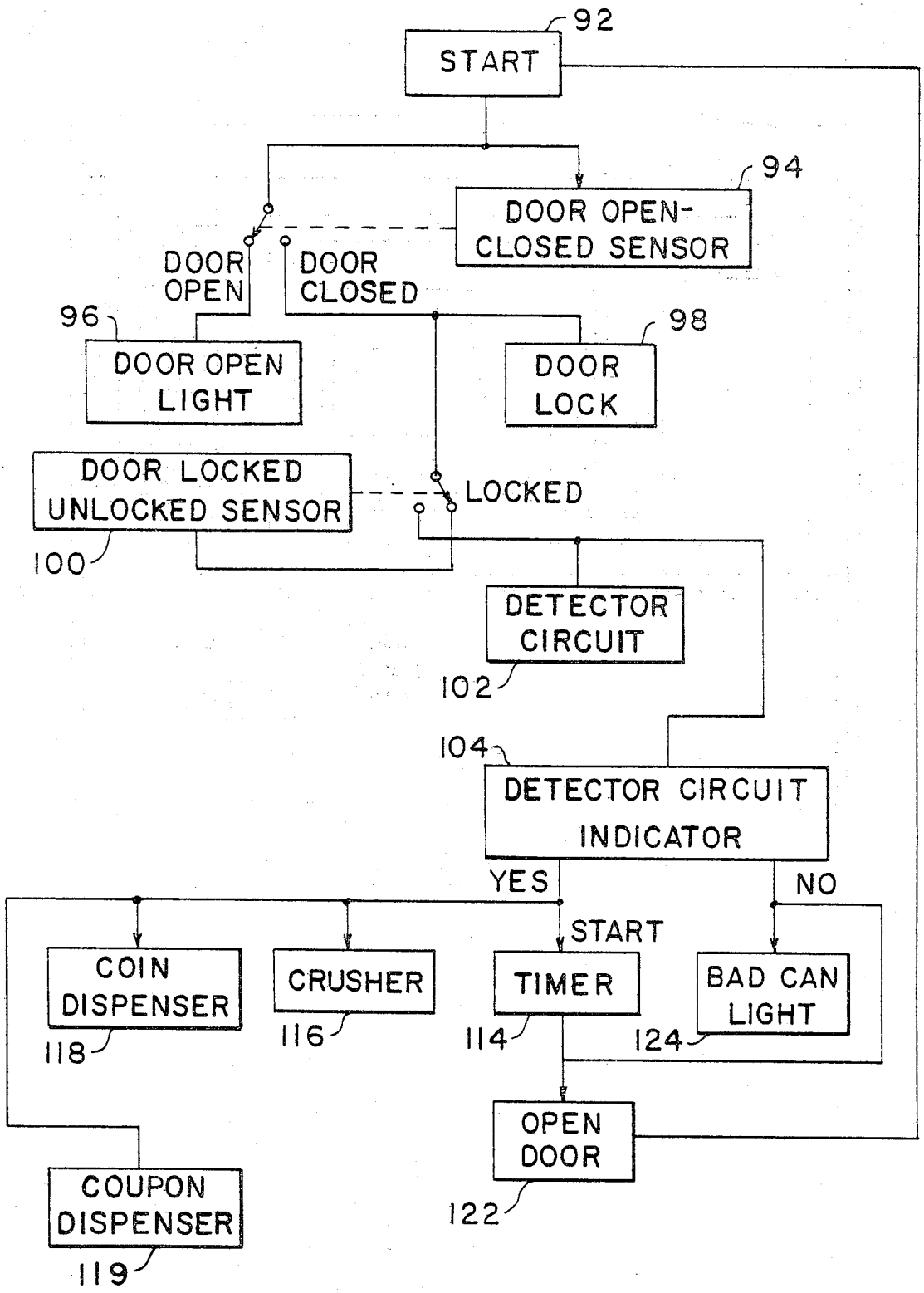
FIG. 7 is a block functional diagram of the electrical components of the apparatus.

As herein embodied and as shown in FIG. 2, a coin chute 64 is provided to channel individual coins or tokens to be dispensed to a slot 66 on the front facing surface 12 of the housing 10. The dispensing means is electrically connected to the sensing means by appropriate circuitry as generally shown in FIG. 7, and is responsive thereto. Thus, coins are dispensed in response to receipt of an aluminum or steel container having the distinguishing indicia which identify it as being entitled to a refund deposit. Preferably, a counter (not shown) may be employed to calculate the refund due for multiple containers received. A coin magazine having coin sleeves for different sized coins may be used with the counter to allow a single refund of correct change in return for receipt of several containers. With this embodiment, a push-button 91 may be used to signal when the refund is to be paid.

The use of the interchangeable coin magazine allows for rapid servicing of the machine since a full coin magazine may be quickly interchanged with the empty or partially filled magazine in the machine.

The coin dispensing means of the apparatus may also include suitable sensors (not shown) to indicate when the coin magazine is emptied and to actuate a signal light on the front of the apparatus.

Figure 6:
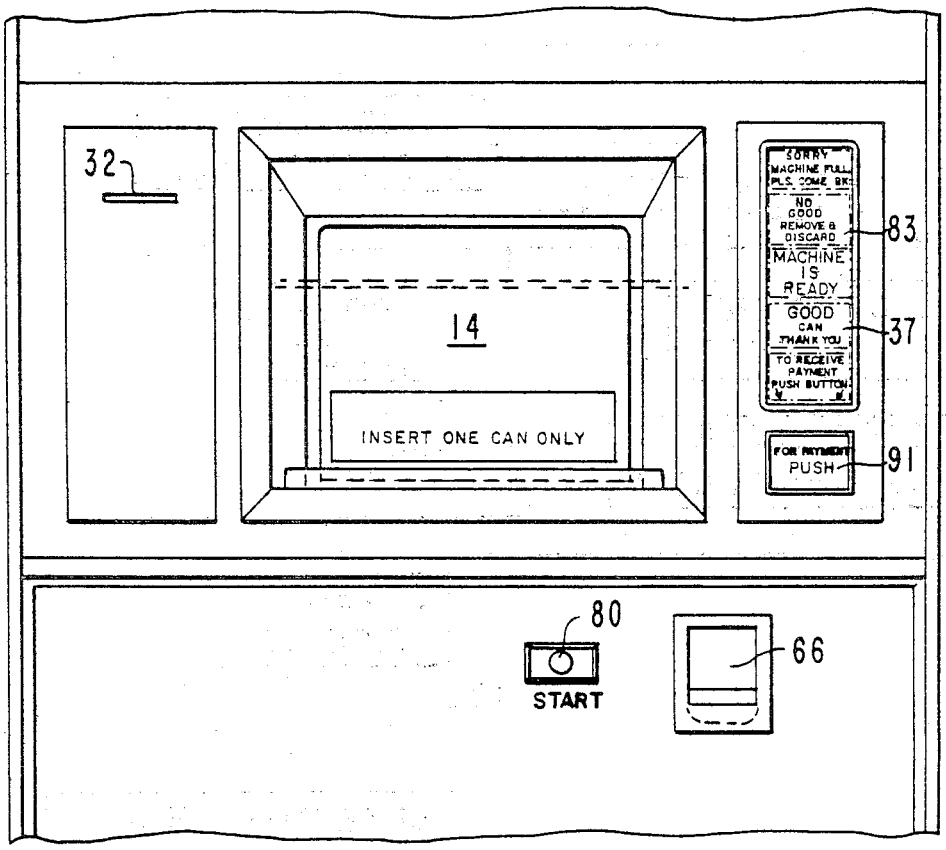
FIG. 6 is an enlarged front view showing the indicator panel and access port.

Preferably, the invention also includes token dispensing means for issuing coupons at predetermined or random intervals for containers collected. As herein embodied, the token dispensing means includes a dispenser 30 mounted within the housing 10, and electrically connected to the preselection means of the apparatus. Individual coupons are dispensed one at a time through a slot 31, which is aligned with an opening 32 (FIG. 6) in the door 12 of housing 10. Preferably, the structure of the token dispenser 30 is conventional, and accommodates rolls of coupons in the form of tickets. The token dispenser may be connected to a counter (not shown) in the coin dispensing means for issuing a coupon only upon acceptance of a predetermined plurality of containers.

This token dispenser acts as an additional inducement for consumers to return containers, since the coupons or tickets may be exchangeable for valuable discounts or prizes.

In accordance with the invention, the apparatus also includes means cooperating with the accepting means for crushing the containers. As herein embodied, the crushing means includes a horizontally reciprocating piston 20, mounted within the housing so as to receive the individual containers by gravity. A suitable driving mechanism 70 is operatively connected to the piston 20 for imparting the necessary reciprocal motion thereto. The driving mechanism includes an electric motor 71 which powers a rotating shaft 73. The motor 71 is mounted onto a supporting bracket 72 by means of bolts 74 or other appropriate fastening means. The shaft is coupled to a piston rod 75 through an eccentric member 77. Rotation of the shaft 73 causes reciprocal motion of piston rod 75, thereby actuating piston 20. In operation, an accepted container falls into a crushing area 69 when the piston 20 is retracted and shelf 16 moves horizontally with piston 20. The container is supported in the crushing area 69 by a weight override support 82 (described in more detail below), which extends to approximately the middle longitudinal axis of the crushing area 69. The piston then cycles back, and the face plate 79 of piston 20 crushes the container against a back plate 81. The crushed container is flattened to a thickness which allows it to by-pass the support 82, thereby falling by gravity into the storage area of the machine. Either immediately after crushing, or on the next cycle of the piston 20 (if the piston 20 initially holds the container by friction against the back plate 81, the crushed container falls by gravity into the storage area of the machine.

In order to prevent the apparatus from crushing full or partially filled containers, the weight override support 82 is provided. When an accepted container drops into the crushing area 69, it is supported by the weight override 82. The support 82 is rotatably connected to a shaft 84 and is biased into its normal can supporting position by a spring 85 surrounding one end of shaft 84. The weight of a container causes a downward force on the support 82, and when that weight is greater than the biasing force of the spring 85, the support 82 opens, allowing the container to drop into the storage area in an uncrushed state. Thus, the interior of the apparatus is not soiled with the contents of the container, and unnecessary attraction of insects or other animals can be reduced.

The compacting motor 71 and its associated structure is particularly efficient in its operation, since it involves only a simple back and forth motion, and utilizes a minimum number of moving parts. This reduces the problems of repair and contributes to the reliability of operation for the machine.

The back plate 81 is also designed to reduce the possibility of damage during operation, and to enhance the reliability of the device. Plate 81 is attached to a support plate 86 by a series of six interior rods 87 and two guide rods 89. The guide rods 89 allow for plate 81 to move horizontally toward support plate 86 under the impact of piston 20. Each of the interior rods 87 is surrounded by a spring 88 for urging plate 81 and plate 86 apart. The guide rods 89 are spaced apart, and extend through support plate 86, plate 81, the face plate 79 and the bracket 72. The rods 89 are fastened at opposite ends by nuts 76. As shaft 73 rotates, eccentric 77 turns, thereby imparting a reciprocal motion to piston rod 75. Piston rod 75 is movably connected at the end opposite the motor 71 to a vertical pin 78. The pin 78 is fixed to a pair of mounts 90 which may be attached to piston 20 or integrally formed therewith. The motion of rod 75 causes piston 20 to slide back and forth on the support rods 89. Thus, the face plate 79 remains properly oriented for crushing the cans. Under the impact of piston 20 on a container, plate 81 acts as both a crushing member and a shock absorber to reduce the possibility of damaging the compactor motor 71 or the other components of the crushing mechanism.

The apparatus also includes storage means for receiving crushed containers from the crushing means and for storing the crushed containers. As herein embodied, the storage means comprises a bag 72 positioned in the lower portion of the housing 10. As illustrated, the bag 72 has a drawstring 74 for facilitating mounting and removal of the bag from the apparatus. The bag 72 is accessible by opening the hinged front wall 12 of the housing 10. Alternatively, a separate disposal door (not shown) may be provided in the housing 10 for removing the bag 72.

An additional signal light 83 may be provided on the front of the housing 10 indicating when a received container is not acceptable. This signal light is connected to the sensing means by appropriate circuitry (not shown) and is responsive to the sensing means.

The sequence of operation of the apparatus of the present invention is initiated when an operator pushes in the door 15 on the front of the housing 10, and inserts a container onto the shelf 16 in the container access area 22. The operator then closes the door 15 and pushes manual push-button 80 on the front wall 12 of the housing 10. Preferably, appropriate electrical circuitry and sensors (FIG. 7) are provided to verify at this point in the operation of the apparatus that the door 15 is closed. This same circuitry may be utilized to activate an optional signal light (not shown) on the front wall 12 of the apparatus to indicate that the door 15 is not fully closed. Activation of the manual push-button also energizes a solenoid (not shown) which operates a mechanism for bolting the door 15 securely.

When the door 15 is securely bolted, an appropriate electrical switch (FIG. 7) is closed causing the sensing mechanism to be energized. The preselection mechanism then activates causing the container to be exposed to an electromagnetic field from the metal detector 34 to determine if the composition of the container is a desired material. If the container is determined to have an undesirable composition, the current to the sensing circuit cuts off, a signal light 83 is activated on the front wall 12 of the apparatus to indicate that the container is not acceptable, and the door 15 is automatically opened. The above sequence of operation will also take place if the manual pushbutton 80 is activated with no container present on the shelf 16. Preferably, appropriate sensing devices may be used in place of the manual push-button 80 to indicate the presence of a container on the shelf 16. In this configuration, the electromagnetic sensing means is energized automatically upon closing of the safety door 15.

Simultaneously with the activation of the detection means, the light source 27 is activated, and the sensors 28 are energized to detect the presence of the distinguishing indicia on the container. If the indicia is detected and if the container is aluminum or steel a signal is generated for payment of the refund.

If the indicator 37 shows that the composition of the container is aluminum or steel and bears a deposit indicia, the motor 71 is stared to cycle the piston 20 allowing the container to drop into the crushing area 69.

The coin dispensing mechanism is also activated in response to an indication from the preselection means of the presence of a desired container. As the piston 20 cycles to crush the container, the coin dispenser ejects appropriate coins through the coin chute 64 to the slot 66. The coin dispenser may also be provided with ircuitry to activate a signal light (not shown) on the front of the apparatus for indicting that the apparatus is full, or that no further coins are available for dispensing.

After ejection of the coins and opertion of the crushing mechanism to compress the container, the apparatus shuts down and is ready for another container. Either immediately after crushing, or on the next crushing cycle, the crushed containers falls by gravity into the bag 72. After crushing is complete, the automaic lock on the safety door 15 is then electrically released and the mahine is ready to receive another container.

The apparatus is designed to operate on standard power supply and is preferably contained within an upright housing which is visually comparable in size to a soft drink dispensing machine.

The block functional diagram in FIG. 7 depicts one embodiment of a circuit for use in the apparatus of this invention. The sequence is initiated by the start block 92 which corresponds to activation of the push-button 80. A door open-closed sensor 94 then checks the status of the door 15. If the door is open, a door-open light 96 is activated. If the door is closed, the door lock 98 is energized and a door-locked sensor 100 initiates the current flow to the detector circuit (block 102). If the detector indicator 104 indicates that a container has the predetermined composition desired and the indicia thereon, crusher 116, coin dispenser 118 and coupon dispenser 119 are activated. When the crusher 116 deactivates, the door 15 is automatically unlocked (122) and the start sequence is reset.

If an undesired composition is detected by the detector indicator 104, a bad can light is then activated as shown at block 124.

It will be apparent to those skilled in the art that various other electrical circuitry could be used without departing from the scope and spirit of the invention.

The apparatus may be provided with separate access ports to accommodate different sized containers or containers or different composition. In addition, the structure of the apparatus may be modified to allow reception of containers of different compositions, with a different token response for each container. In addition, modifications to crush and store the different containers in segregated storage locations could be made by those skilled in the art.

In addition to the apparatus described in detail above, the invention also comprises a method of collecting and storing empty aluminum or steel containers and issuing return deposits for collected containers having a distinguishing indicia thereon. The method of the present invention comprises the steps of simultaneously exposing a crushed or non-crushed container offered by a customer to an electromagnetic field for identifying whether the container is substantially either aluminum or steel without establishing direct electrical contact with the container and to an optical scanning device for detecting the presence of a distinguishing indicia on said container, accepting only a container identified by exposure to the field as being substantially aluminum or steel and having the distinguishing indicia thereon, independent of the configuration of the container, dispensing return deposits for accepted containers having the distinguishing indicia, crushing the containers, and depositing the crushed containers in a receptacle for storage. The method may be accomplished through the use of the apparatus described above, or through any other suitable apparatus which utilizes the disclosed steps.

It will be apparent to those skilled in the art that various other modifications and variations could be made in the structure or method of the invention without departing from the scope and spirit of the invention.

What I claim is:

1. Apparatus for collecting and storing empty metallic containers having a distinguishing indicia thereon and for issuing predetermined return deposits for collected containers comprising:

preselection means for exposing a crushed or non-crushed container offered by a customer to an electromagnetic field for identifying whether said container is substantially either aluminum or steel without establishing direct electrical contact with said container, and for detecting the presence of said distinguishing indicia on said crushed or non-crushed container;

said preselection means including a container access area configured to accommodate both crushed or non-crushed containers for exposure to said field;

means for accepting only a container identified by said preselection means as being substantially aluminum or steel and as having said distinguishing indicia thereon, independent of the configuration of said container;

dispensing means responsive to said preselection means for dispensing a predetermined payment in return for containers having a substantially aluminum or steel composition and carrying said distinguishing indicia;

means cooperating with said accepting means for crushing said containers; and means for storing crushed containers received from said crushing means.

2. The apparatus of claim 1 wherein said distinguishing indicia includes phosphorescing means; and said preselection means includes illuminating means for exposing said crushed or non-crushed container to an ultra-violet light source, and light detection means for generating an electric signal in response to the presence of a predetermined amount of phosphorescence.

3. The apparatus of claim 2 wherein said phosphorescing means includes an ultra-violet sensitive ink, said ink being applied to said container.

4. The apparatus of claim 3 wherein said preselection means includes means for indicating when said container is substantially aluminum or steel.

5. The apparatus of claim 4 wherein said accepting means includes means for depositing said container by gravity into said crushing means.

6. The apparatus of claim 5 also including an exterior housing having an access port therein, for allowing manual insertion of a container into said apparatus into said container access area.

7. The apparatus of claim 6 wherein said housing includes a safety door for covering said access port, and means preventing operation of said apparatus when said safety door is open.

8. The apparatus of claim 7 also including means responsive to the insertion of a container into said access port for actuating said preselection means upon closing of said safety door.

9. The apparatus of claim 7 also including manual push-button means for actuating said preselection means.

10. The apparatus of claim 9 wherein said preselection means includes regret means for actuating a signal when a received container does not have both a substantially aluminum or steel composition and a distinguishing indicia present thereon.

11. The apparatus of claim 10 wherein said means for storing comprises a bag and said housing includes a disposal door for permitting removal of said bag.

12. The apparatus of claim 11 wherein said dispensing means includes an interchangeable coin magazine.

13. A method of collecting and storing empty metallic containers, having a distinguishing indicia thereon and issuing return deposits for collected containers, comprising the steps of:

simultaneously exposing a crushed or non-crushed container offered by a customer to an electromagnetic field for identifying whether said container is substantially aluminum or steel without establishing direct electrical contact with said container, and to a device for detecting the presence of a distinguishing indicia on said container;

accepting only a container identified by exposure to said field as being substantially aluminum or steel and bearing the distinguishing indicia, independent of the configuration of the container;

dispensing return deposits for containers accepted;

crushing the accepted containers; and depositing the crushed containers in a receptacle for storage.

* * * * *